United States Patent [19]

Fong et al.

[11] 4,389,820

[45] Jun. 28, 1983

[54] BLASTING MACHINE UTILIZING SUBLIMABLE PARTICLES

[75] Inventors: Calvin C. Fong, Beverly Hills; John W. Altizer, Simi Valley; Vernon E. Arnold, Fillmore; John K. Lawson, Granada Hills, all of Calif.

[73] Assignee: Lockheed Corporation, Burbank, Calif.

[21] Appl. No.: 220,372

[22] Filed: Dec. 29, 1980

[51] Int. Cl.[3] ..... B24C 3/00; B24C 1/00

[52] U.S. Cl. ..... 51/410; 51/320

[58] Field of Search ..... 51/320, 321, 410, 424, 51/439

[56] References Cited

U.S. PATENT DOCUMENTS

| | | | |
|---|---|---|---|
| 2,717,476 | 9/1955 | Myers | 51/439 |
| 3,676,963 | 7/1972 | Rice et al. | 51/320 |
| 4,038,786 | 8/1977 | Fong | 51/320 |

FOREIGN PATENT DOCUMENTS

| | | | |
|---|---|---|---|
| 596956 | 3/1978 | Switzerland | 51/439 |

*Primary Examiner*—James G. Smith

*Attorney, Agent, or Firm*—Frederic P. Smith

[57] ABSTRACT

A blasting machine utilizing sublimable particles comprising forming means (14) for producing particles having a substantially uniform length thereto, dispensing means (32) for receiving the particles and for introducing the particles into a low pressure transport gas flow, and a nozzle (44) for accelerating the particles and having a high pressure, low velocity gas flow coupled to it, the nozzle (44) being adapted to convert the high pressure, low velocity gas flow into a low pressure, high velocity gas flow. A conduit (142) coupled to the nozzle (44) and the dispensing means (32) receives the particles and introduces the particles into the low pressure, high velocity gas flow within the nozzle (44) which entrains the particles and accelerates them to a high exit velocity.

22 Claims, 10 Drawing Figures

BLASTING MACHINE UTILIZING SUBLIMABLE PARTICLES

TECHNICAL FIELD

The invention relates to the field of blasting machines and, in particular, to blasting machines utilizing particles of material capable of sublimation.

BACKGROUND ART

This invention is an improvement over the particle blasting system described in U.S. Pat. No. 4,038,786 entitled "Sandblasting With Pellets of Material Capable of Sublimation" and assigned to the assignor of this invention. In that patent a system was described for blasting with solid carbon dioxide particles to clean, for example, various different types of surfaces of various different types of contaminants. The advantages of using solid carbon dioxide particles is that there is no resultant cleaning up of the particles after blasting and essentially no atmospheric contamination. As described further in such patent, numerous problems have been encountered in the use of dry ice particles for blasting purposes. The problems recited relate generally to a limited density of the particle, rounded edge and corner configurations of such a particle and non-uniformity of the blasting stream because of particle feed variations due to agglomeration. While these problems were generally solved by the teachings of such patent, nonetheless other problems arose which caused the system to operate less than satisfactory. These problems related to insufficient velocity of the particles in the gas stream, non-uniformity and breaking of particles, back up and insufficient feed of particles into the gas stream and freezing incurring in the area of the feed mechanism and the nozzle.

Accordingly, it is a general object of the present invention to provide a blasting machine utilizing particles of material capable of sublimation.

It is another object of the present invention to provide a blasting machine for sublimable particles which is capable of imparting a high velocity to the particles without causing damage to the particles.

It is a further object of the present invention to provide a blasting machine for sublimable particles which can provide a high volume of particles into a low pressure, high velocity gas flow.

It is still another object of the present invention to provide a blasting machine for sublimable particles which can easily provide particles having a substantially uniform length.

It is a further object of the present invention to provide a blasting machine in which the temperature of the gas flow into the feed mechanism and the nozzle is regulated to prevent freezing in such regions and to assist in the acceleration of the particles.

DISCLOSURE OF INVENTION

A blasting machine utilizing particles of material capable of sublimation is provided. The blasting machine comprises a forming means for producing particles having a substantially uniform length and a dispensing means for receiving the particles and for introducing the particles into a low pressure transport gas flow. The blasting machine also includes a nozzle for accelerating the particles which has a high pressure, low velocity gas flow coupled to it and which converts the high pressure, low velocity gas flow into a low pressure, high velocity gas flow. A conduit coupled to the nozzle and the dispensing means receives the particles and introduces the particles into the low pressure, high velocity gas flow within the nozzle which entrains the particles and accelerates them to a high exit velocity.

The novel features which are believed to be characteristic of the invention, both as to its organization and its method of operation, together with further objects and advantages thereof, will be better understood from the following description in connection with the accompanying drawings in which a presently preferred embodiment of the invention is illustrated by way of example, It is to be expressly understood, however, that the drawings are for purposes of illustration and description only and are not intended as a definition of the limits of the invention.

BEST MODE FOR CARRYING OUT THE INVENTION

Figure 1:
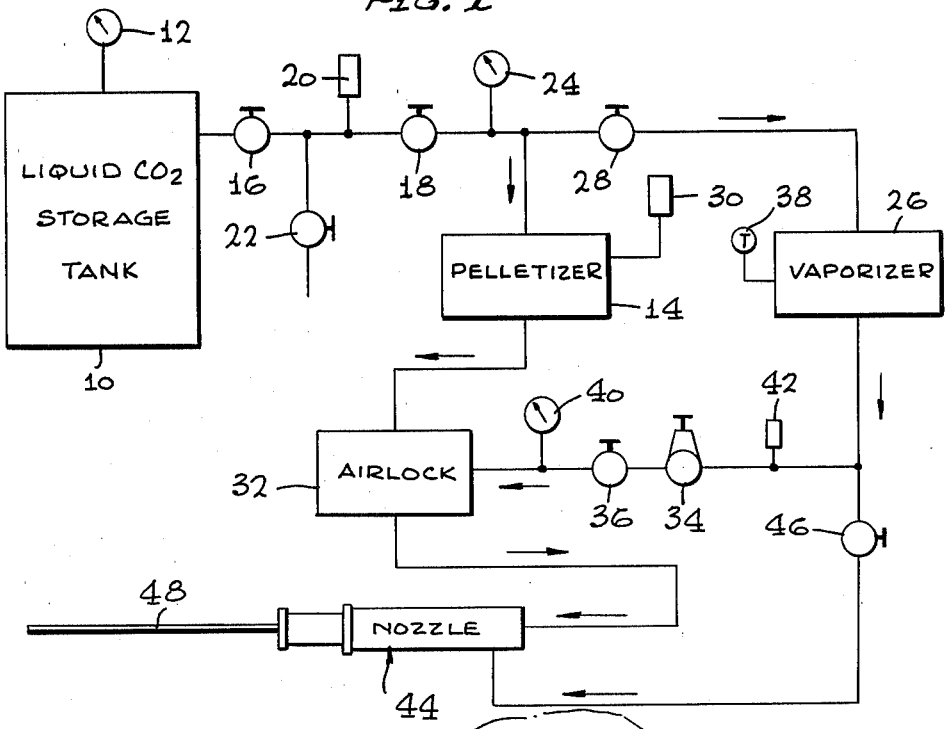
FIG. 1 is a block schematic diagram of the blasting machine of the present invention.

Referring now to FIG. 1, a block schematic diagram of the blasting machine of the present invention is illustrated. A liquid carbon dioxde storage tank 10 having a pressure gauge 12 thereon is coupled to a dry ice particle forming machine 14, such as a pelletizer of the type made by Airco Cryogenics, Irvine, California, by a pair of supply valves 16 and 18. The liquid carbon dioxide storage tank 10 also has coupled thereto a safety valve 20 and a vent line valve 22. A pressure gauge 24 is provided after the supply valve 18 in order to determine the pressure of the liquid carbon dioxide entering the forming machine or pelletizer 14. A vaporizer 26 which converts the liquid carbon dioxide into a high pressure gas is coupled to the liquid carbon dioxide storage tank 10 through a supply valve 28. The pelletizer 14, which has a safety valve 30 coupled thereto, manufactures dry ice particles or pellets, as described further hereafter, and feeds such dry ice particles or pellets through a dispensing means 32, such as the rotary airlock described hereafter, to which is coupled a low pressure transport gas from the vaporizer 26 through a pressure regulator 34 and a supply valve 36. A temperature gauge 38 is provided to be able to regulate the temperature of the gas exiting from the vaporizer 26 and a pressure gauge 40 is used to determine the pressure of the gas entering the dispensing means or airlock 32. A safety valve 42 is provided in the gas line between the vaporizer 26 and the dispensing means or airlock 32. The particles or pellets are transported from the dispensing means or airlock 32 to a blasting nozzle 44 through a reduced pressure line by the low pressure transport gas flow. A high pressure, low velocity gas flow is coupled to the blasting nozzles 44 through a supply valve 46 where it is converted within the blasting nozzle 44 into a low pressure, high velocity gas flow. The dry ice particles or pellets delivered by the transport gas to the blasting nozzle 44 are introduced into the low pressure, high velocity gas flow within the nozzle 44 and are entrained in the low pressure, high velocity gas flow, accelerated out a gradually diverging tube 48 having a very long taper coupled to the blasting nozzle, and directed to strike the surface to be blasted.

Figure 3:
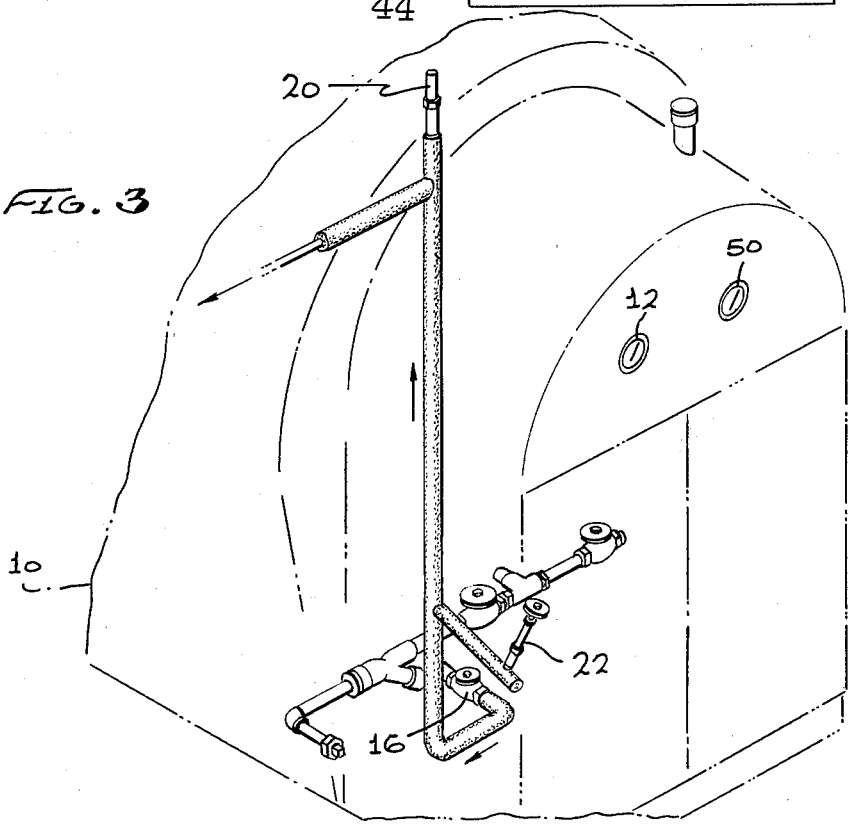
FIG. 3 is a fragmentary view of the liquid carbon dioxide storage tank of the present invention.
Figure 2:
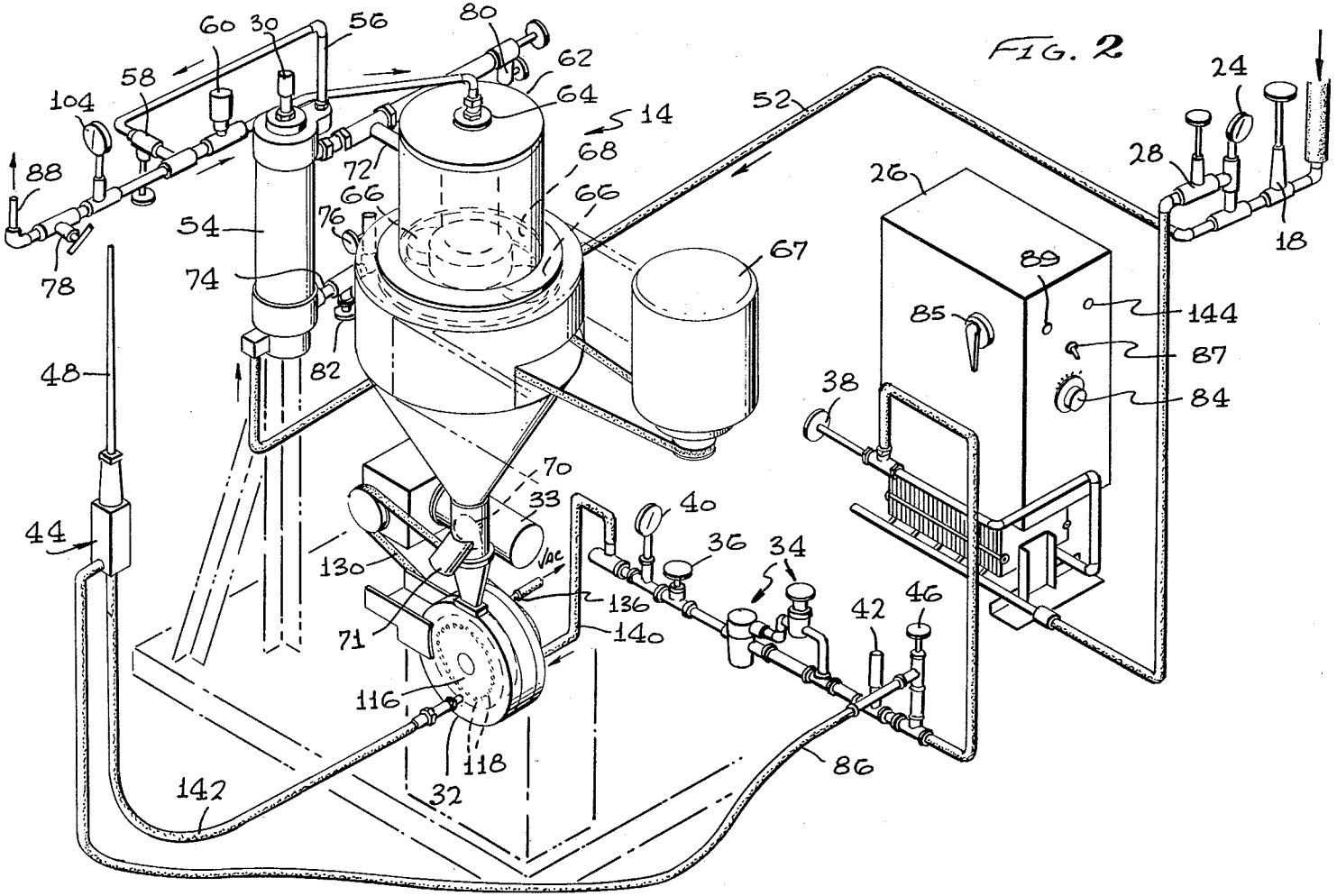
FIG. 2 is a perspective view of the blasting machine of the present invention.
Figure 4:
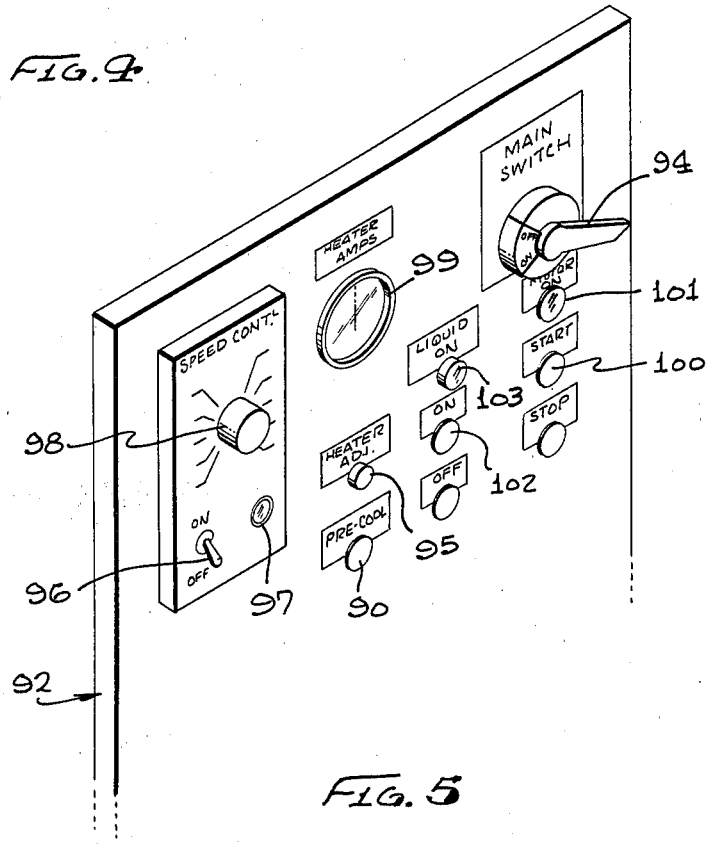
FIG. 4 is a fragmentary view of the control panel of the present invention.

Referring now to FIGS. 2, 3, and 4, the liquid carbon dioxide is supplied from the storage tank 10 through the supply valve 16 and the supply valves 18 and 28 to the pelletizer 14 and the vaporizer 26, respectively. The liquid carbon dioxide storage tank 10 has a contents gauge 50 and the pressure gauge 12 thereon which are used to verify that the liquid carbon dioxide supply is operational. The contents gauge 50 should show approximately 6,000 pounds of liquid carbon dioxide and the pressure gauge 12 should show an operating pressure of approximately 300 psig. The supply valve 18 is coupled to the pelletizer 14 through a conduit 52 which connects to the lower portion of a heat exchanger 54. The liquid carbon dioxide exits the heat exchanger 54 through a conduit 56 which is coupled to the pelletizer 14 through throttle valve 58 and supply solenoid valve 60. The liquid carbon dioxide enters the snow chamber 62 of the pelletizer 14 through an expansion valve 64 where the liquid carbon dioxide at a pressure of 300 psi and a temperature of 0° F. is converted to snow at a temperature of less than —109° F. As will be explained in more detail hereafter, the snow is compacted, by orbiting pelletizer rollers 66 driven by motor 67, through a pellet die 68 to form dry ice pellets which are delivered through airlock selector valve 70 to the rotary airlock 32. Cold carbon dioxide gas exits the snow chamber 62 through conduit 72 into the heat exchanger 54 and then out through conduit 74 and check valve 76, thereby cooling the high pressure liquid carbon dioxide before it enters the snow chamber 62.

In operation, the blasting machine is set up in an initial condition in which supply valves 16 and 18 are closed, supply valve 28 is open, heat exchanger purge valve 78 is closed, liquid carbon dioxide throttle valve 58 is open, heat exchanger bypass valve 80 is open, check valve bypass valve 82 is closed, airlock selector on valve 70 is set to bypass position, propellant gas supply valve 46 is closed, and airlock gas supply valve 36 is closed. To start the blasting machine in operation, supply valve 16 is opened and then supply valve 18 is opened. At this point the supply pressure gauge 24 should read approximately 300 psig. The power to the vaporizer 26 is then turned on by main switch 85 and the vaporizer 26 is turned on by control switch 87, as indicated by light 89. The vaporizer temperature control dial 84 should then be set to a position previously determined to yield a gas temperature of 150°-200° F. and the propellent gas supply valve 46 should be opened slowly to allow a flow of carbon dioxide gas through the high pressure propellent hose 86 to the nozzle 44. When the gas temperature reaches 150°-200° F., the airlock gas supply valve 36 is opened slightly and the airlock pressure regulator 34 is adjusted to obtain a 50 psig reading on the airlock supply pressure gauge 40. The airlock gas supply valve 36 is then fully opened and the airlock pressure regulator 34 is readjusted to 50 psig. The heat exchanger purge valve 78 is then fully opened until liquid carbon dioxide begins to flow out through the vent pipe 88, at which point the heat exchange purge valve 78 is closed. Liquid carbon dioxide supply solenoid valve 60 is then opened by depressing the pre-cool button 90 on the pelletizer control panel 92 thus allowing liquid carbon dioxide to flow through the throttle valve 58 and the supply solenoid valve 60 to the snow chamber 62 of the pelletizer 14 and create snow in the snow chamber 62 of the pelletizer 14. Prior to depressing the pre-cool button 90 on the pelletizer panel 92, the main switch 94 for the pelletizer 14 should be placed in the ON position, speed control ON-OFF switch 96 for the airlock 32 should be set to the ON position, as indicated by light 97, and the speed control dial 98 should be set to the desired setting for the motor 33 for the airlock 32. The motor start button 100 and the liquid ON button 102 are then pressed on the pelletizer control panel 92, as indicated by lights 101, 103, respectively, and the throttle valve 58 is adjusted to obtain a 270 psig reading at the liquid pressure gauge 104 between the throttle valve 58 and the supply solenoid valve 60. When the motor start button 100 is pressed, the pelletizer rollers 66 driven by motor 67 orbit in the snow chamber 62 in a counter-clockwise direction and force the snow to compact and to be extruded through the pellet die 68 to form the dry ice pellets. The depressing of the liquid ON button 102 causes an emitter wire (not shown) in the snow chamber 62 to glow hot and to act as an anti-static agent. The temperature of the emitter wire is adjusted by heater adjust 95 and the amperage therethrough is indicated by gauge 99. During the beginning stage of operation, vapor and air are vented through heat exchanger by-pass valve 80. When dry ice pellets appear at the outlet 71 of the airlock selector valve 70, the check valve byapss valve 82 is opened and the heat exchanger bypass valve 80 is closed. At this point cold carbon dioxide gas coming out of the snow chamber 62 goes into the heat exchanger 54 and out through check valve bypass 82. When no more snow is discharged with the dry ice pellets at outlet 71 and the dry ice pellets have a good configuration, the check valve bypass valve 82 is closed and the cold carbon dioxide gas exits through check valve 76.

Figure 5:
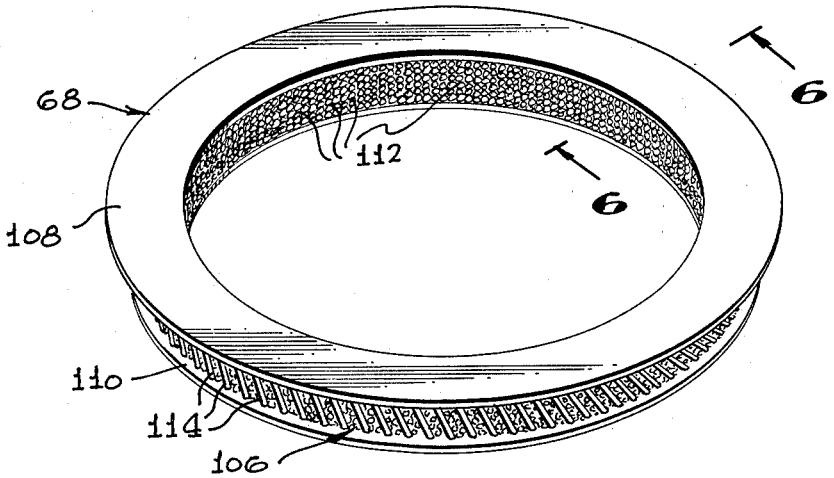
FIG. 5 is a perspective view of the particle die of the present invention.
Figure 6:
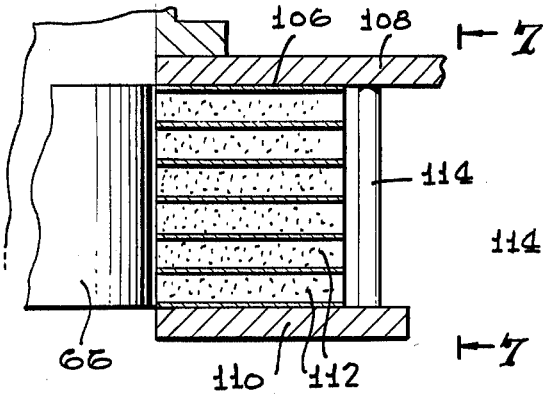
FIG. 6 is a cross-sectional view of the particle die of FIG. 5 along the lines 6—6 of FIG. 5.
Figure 7:
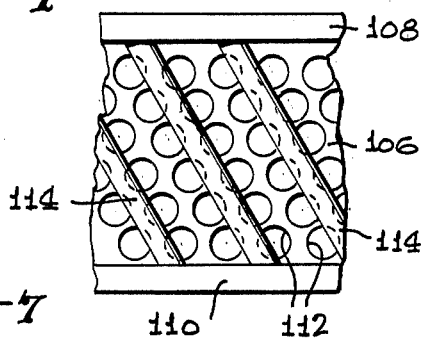
FIG. 7 is a side view of the particle die of FIG. 5 taken along lines 7—7 of FIG. 6.

In FIGS. 5, 6 and 7 the pellet die 68 of the presentinvention is illustrated. As can be seen in the Figures, the pellet die 68 consists of a hollow cylindrical block 106 and top and bottom plates 108, 110, the block 106 having a plurality of radially extending holes 112 into which the carbon dioxide snow is compacted due to the operation of the pelletizer rollers 66. The compacted snow is extruded through the plurality of holes 112 in the form of cylindrical pellets to the outside perimeter of the pellet die 68. At the exits of the plurality of holes 112, the cylindrical pellets encounter a plurality of pins 114 which cause the pellets to be diverted away from the axes of the holes 112 and to eventually break off through a shearing action. Thus, through the placement of the pins 114, a substantially uniform length is imparted to the pellets, allowing for the satisfactory operation of the blasting machine. It is apparent that the diameter of the pellets can be controlled by selecting the diameter of the holes 112 in the pellet die 68 and the length of the pellets can be determined by the distance the pins 114 are located away from the exits of the holes 112 in the pellet die 68 and also by the placement of the pins 114 with respect to the axes of the holes 112 in the pellet die 68. It is also apparent that cross-sectional shapes other than cylindrical, such as hexagonal or octagonal, can be provided for the pellets by altering the configuration of the holes 112 in the pellet die 68.

Figure 8:
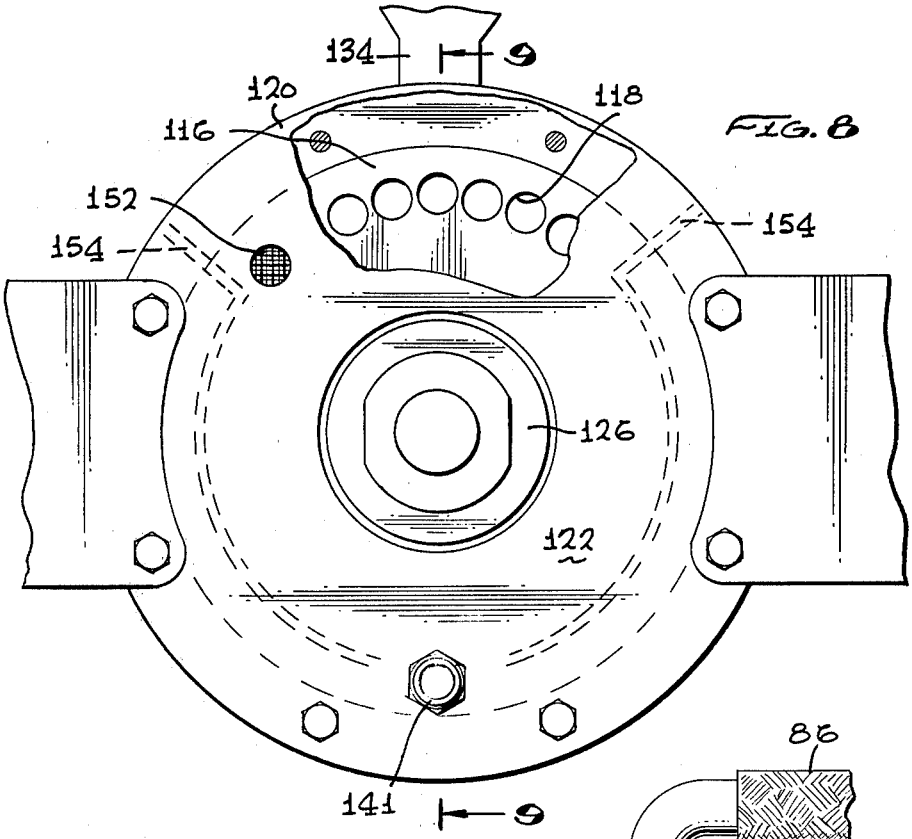
FIG. 8 is a front view, partially broken away, of the dispensing means of the present invention.
Figure 9:
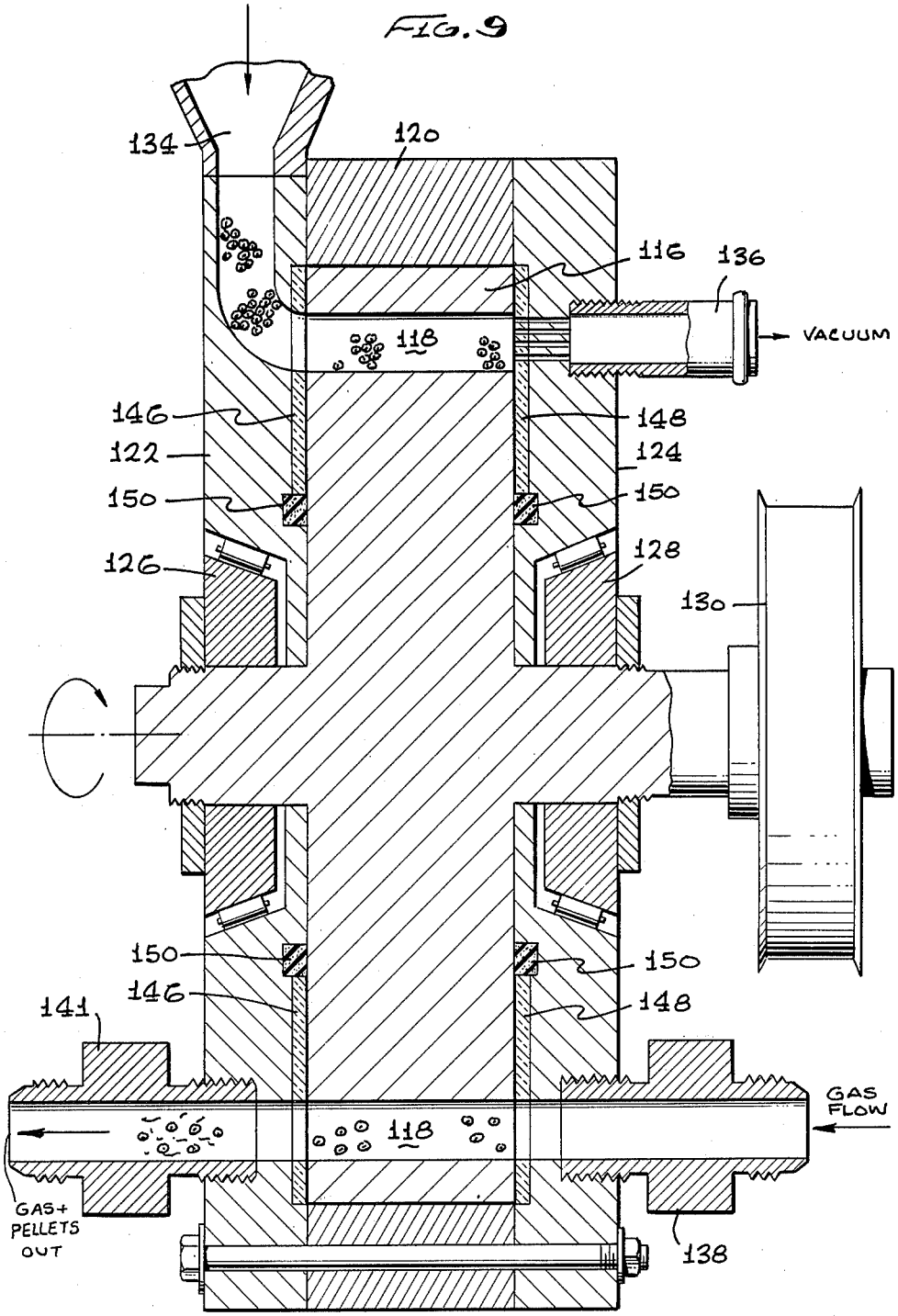
FIG. 9 is an enlarged cross-sectional view of the dispensing means of the present invention taken along the lines 9—9 of FIG. 8.

The pellets extruded from the pellet die 68 are then funneled by gravity through airlock selector valve 70, which has been switched to the airlock position, into the airlock 32 for ultimate transportation to the blasting nozzle 44. As shown in FIGS. 2, 8 and 9, the rotary airlock 32 comprises a rotor 116 having a plurality of holes or chambers 118 extending therethrough around the circumference thereof. The rotor 116 is contained within a center ring 120 and front and rear cover plates 122, 124, is supported by front and rear thrust bearings 126, 128, and is driven by drive pulley 130 and motor 33. The pellets enter the airlock 32 through the pellet inlet 134 and are aspirated into the circumferential holes 118 by a vacuum applied to the rear side of the holes 118 via the vacuum fitting 136. This vacuum aspiration allows a large number of pellets to enter the circumferential holes 118 of the airlock 32 and prevents a backlog of pellets in the pellet inlet 134, due in general to the right angle bend of the pellet inlet 134. Due to the motion of the rotor 116, the pellets contained within the circumferential holes or chambers 118 are brought from a first position opposite the vacuum fitting 136 where they have been aspirated into the chambers 118 to a second position opposite coupling 138 where they are subject to a low pressure transport gas flow via conduit 140 connected to coupling 138 which causes the pellets to be discharged from the chambers 118 into the coupling 141 and the conduit 142 which is coupled to the blasting nozzle 44. The speed of the airlock rotor 116 is adjusted by the speed control dial 98 on the pelletizer control panel 92 in accordance with the delivery rate of pellets from the pelletizer 14 to ensure a uniform delivery of pellets by the low pressure transport gas to the blasting nozzle 44. If desired, the introduction of the low pressure transport gas into the chambers 118 can be regulated by inserting a plug (not shown) into the coupling 138 having an orifice of desired shape and position with respect to the opening in the cover plate 124 interfacing with the chambers 118.

Prior to the use of the blasting nozzle 44, the temperature control dial 84 on the vaporizer 26 should be set to a position previously determined to yield a propellant gas temperature of approximately 250°–275° F. and the propellant gas temperature should be monitored by dial thermometer 38 so that the propellent gas temperature does not exceed 275° F. or does not drop below 100° F. The temperature is regulated on the high side by turning the temperature control dial 84 down until the contactor on the heaters of the vaporizer 26 cause the light 144 to become dark and on the low side by closing the propellent gas supply valve 46 and allowing the airlock gas supply valve 36 to remain open until the gas temperature returns to the proper operating range. The gas flowing through the airlock pressure regulator 34 drops from a pressure of 300 psig to a pressure of 50 psig and in so doing drops in temperature from 275° F. to approximately 110° F. This flow of heated gas prevents the plugging up of the airlock 32, the chambers 118 and the conduit 142 due to excessive cold and the plugging up of those components due to formation of carbon dioxide snow within those components at points where large pressure drops occur, e.g., the airlock pressure regulator 34 and the blasting nozzle 44 where the high pressure, low velocity gas flow is converted to a low pressure, high velocity gas flow. As can be seen in FIGS. 8 and 9, bearing plates 146, 148 and teflon seals 150 are provided on both sides of the rotor 116 to contain the vacuum where the pellets are fed into the chambers 118 and to contain the low pressure gas flow where the pellets are exited from the chambers 118. In addition, pressure vent holes 152, 154 are provided at appropriate places to bring the pressures in the chambers 118 (due to the vacuum and the low pressure gas flow) to ambient so that a chamber 118 does not have a vacuum in it when the low pressure gas flow is applied and does not have a pressure within it when the pellets are introduced into it and the vacuum is applied.

Figure 10:
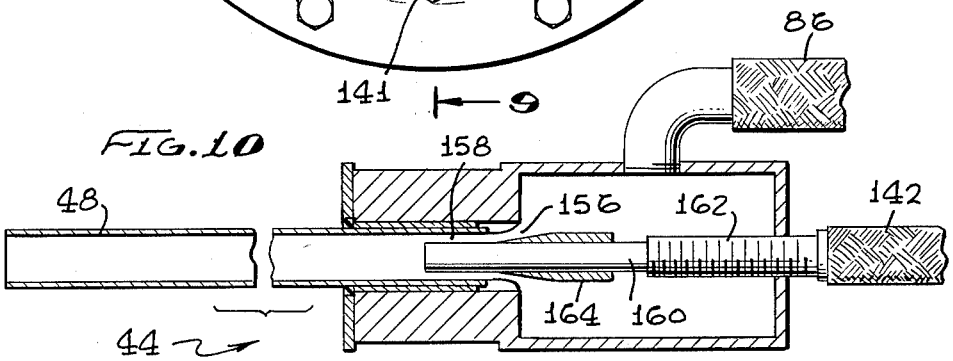
FIG. 10 is a simplified cross-sectional view of the blasting nozzle of the present invention.

When blast cleaning of a surface is desired, the propellent gas supply valve 46 is fully opened and a high pressure, low velocity gas having a pressure of approximately 300 psig is applied to the blasting nozzle 44 through the propellent hose 86, as illustrated in FIGS. 2 and 10. The interior of the nozzle 44 is contoured so that the high pressure, low velocity gas flow is converted into a low pressure, high velocity gas flow. This is accomplished by causing the high pressure, low velocity gas flow to go through a converging region 156 followed by a diverging region 158. This general configuration is termed a venturi nozzle when the velocity of the gas flow is subsonic and a supersonic nozzle when the gas flow velocity exceeds the speed of sound due to a sufficiently high pressure of the gas flow. As is shown in FIG. 10, the amount of constriction within the nozzle 44 during the converging part thereof can be adjusted by rotating the conduit 142 with respect to the nozzle 44, the conduit 142 being coupled to tube 160 which has a threaded portion 162 and a cylindrically tapered member 164 mounted circumferentially thereof. The rotation of the conduit 142 and tube 160 causes the cylindrically tapered member 164 to extend more or less into the converging region 156 and thus to adjust the magnitude of the pressure and velocity of the high pressure, low velocity gas along the interior of the nozzle 44. By proper adjustment and positioning of the tube 160, the pellets are delivered at a preselected position along the nozzle 44 where the propellent gas has a low pressure and a high velocity. In such region, the local static pressure may be equal to or even less than the static pressure in the surrounding environment. The pellets are entrained in the high velocity gas flow and are accelerated to a velocity sufficient to blast the intended surface. To further improve the acceleration of the particles, the gradually diverging tube 48 with the very long taper is coupled to the nozzle 44 to provide an extended diverging region to enhance the acceleration of the pellets to a high exit velocity.

As stated previously, the propellant gas temperature is regulated not to exceed 275° F. The temperature of the high pressure, low velocity carbon dioxde gas is maintained at approximately 250° F. and has an exit velocity of 1325 ft/sec, for an isentropic flow and a nozzle and input pressure providing Mach 1.5, as contrasted to an exit velocity of 1177 ft/sec for a carbon dioxide gas of temperature 100° F. Thus the heating of the propellant gas also yields a 12.6% increase in exit velocity. The exit velocity of the propellant gas can be increased by using air which would have an exit velocity of 1627 ft/sec at 250° F., a 22.8% velocity increase, or a 50/50 mixture by volume of air and helium which would have an exit velocity of 2150 ft/sec at 250° F., a 62.3% velocity increase, for the conditions recited above.

Having thus described the invention, it is obvious that numerous modifications and departures may be made by those skilled in the art. While the use of dry ice particles has been illustrated, other types of sublimable particles may be used as described in the aforementioned patent. Furthermore, particle forming and dispensing machines other than the pelletizer and the rotary airlock described herein can be used to produce and feed the sublimable particles. Gases other than carbon dioxide may be utilized to transport and propel the particles and the vaporizer may be omitted if a sufficiently high pressure and temperature source of gas is utilized. The configuration of the nozzle may also be varied as long as the particles are entrained in and accelerated by a sufficiently high velocity gas flow to achieve the desired blasting effect. Thus, the invention is to be construed as being limited only by the spirit and scope of the appended claims.

Industrial Applicability

The blasting machine is useful in the blasting of surfaces where it is desired that there be no clean up of particles after blasting and no atmospheric contamination due to the use of the particles.

We claim:

1. A blasting machine utilizing particles of materials capable of sublimation comprising:

forming means for producing said particles, said forming means including means for causing said particles to have a substantially uniform length thereto;

dispensing means coupled to said forming means and adapted to receive said particles from said forming means and to introduce said particles into a low pressure transport gas flow;

nozzle means for accelerating said particles and having a high pressure, low velocity gas flow coupled thereto, said nozzle means being adapted to convert said high pressure, low velocity gas flow into a low pressure, high velocity gas flow; and conduit means coupled to said nozzle means and said dispensing means for receiving said particles and said low pressure transport gas flow and for enabling said low pressure transport gas flow to transport said particles to said nozzle and to deliver said particles into said low pressure, high velocity gas flow within said nozzle;

whereby said particles are entrained in said high velocity gas flow and are accelerated thereby.

2. The blasting machine of claim 1 wherein said forming means includes a die having a plurality of holes therein from which said particles are extruded and said means for causing said particles to have a substantially uniform length thereto comprises a plurality of pins positioned with respect to said holes to deflect said extruded particles to cause said particles to shear at a preselected length.

3. The blasting machine of claim 1 wherein said forming means comprises a pelletizer and said particles comprise pellets formed in said pelletizer with a substantially uniform length thereto.

4. The blasting machine of claim 1 wherein said dispensing means includes a plurality of rotating chambers which are adapted to receive said particles at a first position and to discharge said particles at a second position.

5. The blasting machine of claim 4 wherein said forming means is coupled to said dispensing means at said first position to deliver said particles to said rotating chambers.

6. The blasting machine of claim 5 further including vacuum means coupled to said dispensing means at said first position for aspirating said particles into said chambers.

7. The blasting machine of claim 4 further including means for introducing a low pressure gas flow into said chambers at said second position to discharge said particles into said conduit means.

8. The blasting machine of claim 7 further including means for regulating the introduction of said low pressure gas flow into said chambers.

9. The blasting machine of claim 1 or 7 further comprising means for regulating the temperature of said low pressure gas flow.

10. The blasting machine of claim 1 further comprising means for regulating the temperature of said high pressure, low velocity gas flow.

11. The blasting machine of claim 1 wherein said dispensing means comprises a rotary airlock.

12. The blasting machine of claim 1 wherein said nozzle means has a converging region to reduce the pressure of said high pressure, low velocity gas and to increase the velocity of said high pressure, low velocity gas.

13. The blasting machine of claim 12 wherein said nozzle means has a diverging region following said converging region along the direction of flow of said high pressure, low velocity gas.

14. The blasting machine of claim 13 wherein said conduit means introduces said particles at a preselected position within said diverging region.

15. The blasting machine of claim 13 wherein said conduit means has adjustment means coupled thereto adapted for insertion into said converging and diverging regions of said nozzle means for adjusting the magnitude of the pressure and velocity of said high pressure, low velocity gas along said nozzle means.

16. The blasting machine of claim 15 wherein said adjustment means further introduces said particles at a preselected position along said nozzle means.

17. The blasting machine of claim 13 wherein the diverging region of said nozzle means further includes an extended tube with a gradually diverging taper to accelerate said pellets to a high exit velocity.

18. The blasting machine of claim 13 wherein said nozzle means comprises a supersonic nozzle.

19. The blasting machine of claim 1 wherein said particles are composed of solid carbon dioxide and further including means coupled to said forming means for delivering liquid carbon dioxide thereto.

20. The blasting machine of claim 19 further including vaporizer means coupled to said means for delivering liquid carbon dioxide for producing therefrom said low pressure gas flow and said high pressure, low velocity gas flow.

21. The blasting machine of claim 1 wherein said gas flows consist of air.

22. The blasting machine of claim 1 wherein said gas flows consist of a mixture of air and helium.

* * * * *